US005819939A

United States Patent [19]

Boyer

[11] Patent Number: 5,819,939

[45] Date of Patent: Oct. 13, 1998

[54] INTERCONNECTING BLISTER PACKAGE

[75] Inventor: David C. Boyer, Madison, Wis.

[73] Assignee: Placon Corporation, Madison, Wis.

[21] Appl. No.: 956,321

[22] Filed: Oct. 23, 1997

[51] Int. Cl.[6] ..... B65D 73/00

[52] U.S. Cl. ..... 206/461; 206/806

[58] Field of Search ..... 206/461, 464, 206/467, 468, 469, 470, 471, 477, 478, 479, 480, 481, 482, 483, 769, 771, 776, 806; 220/23.4

[56] References Cited

U.S. PATENT DOCUMENTS

| | | | |
|---|---|---|---|
| 3,325,050 | 6/1967 | Wanamaker | 221/25 |
| 3,840,114 | 10/1974 | Sama | 206/461 |
| 4,401,213 | 8/1983 | Lerner | 206/205 |
| 4,415,084 | 11/1983 | Hauser et al. | 206/461 |
| 5,405,022 | 4/1995 | Rissley | 211/59.1 |
| 5,649,624 | 7/1997 | Seaton | 206/461 |

FOREIGN PATENT DOCUMENTS

| | | | |
|---|---|---|---|
| 245478 | 2/1996 | Austria . | |
| 2713-543 | 10/1978 | Germany | B65D 81/36 |
| 3924-138-A | 1/1991 | Germany | B65D 43/20 |

*Primary Examiner*—Paul T. Sewell
*Assistant Examiner*—Jermie E. Cozart
*Attorney, Agent, or Firm*—Lathrop & Clark

[57] ABSTRACT

A thermoformed thermoplastic blister is connected to a backing card. The blister has a peripheral flange which is positioned adjacent the backing card, and a bubble which protrudes frontwardly from the flange. A catch is formed in the flange, and is deformed rearwardly through an opening in the card to extend downwardly. The plastic catch extends into a narrow slot on the bubble of another like package. The slot is approximately the same width as the catch and need be only slightly taller than the thickness of the flange. With this connection structure multiple packages may be supported one upon another. In addition, the packages will automatically link to one another when extracted from a shipping carton. The rearwardly protruding catch may be formed from the plastic flange alone, or may be formed together with a portion of the backing card for additional strength. The plastic catch may be deformed by heat or pressure, or may be held in a rearwardly extending position by interaction with configured slots on the backing card. Alternatively, the flange may be molded to deform a portion of the backing card to act as the catch. More than one catch and slot may be formed in a package to support greater loads with improved balance.

20 Claims, 4 Drawing Sheets

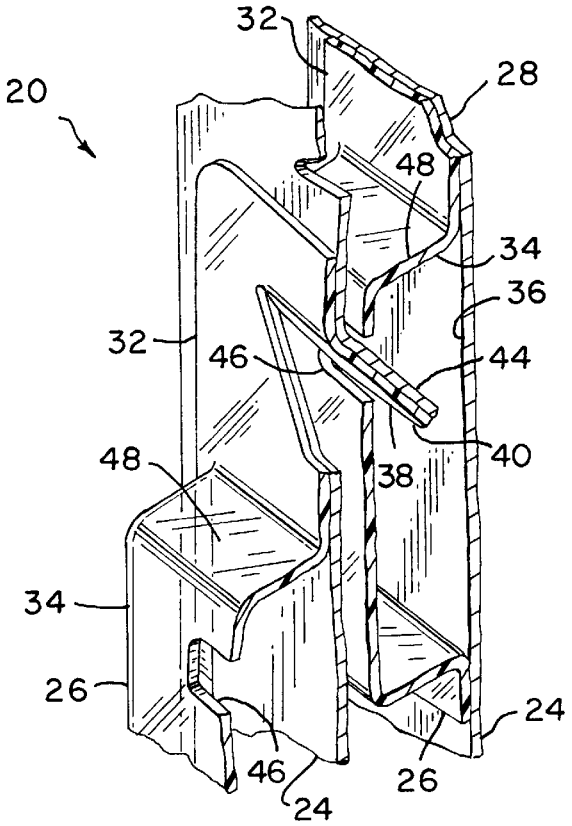
FIG. 3
FIG. 4
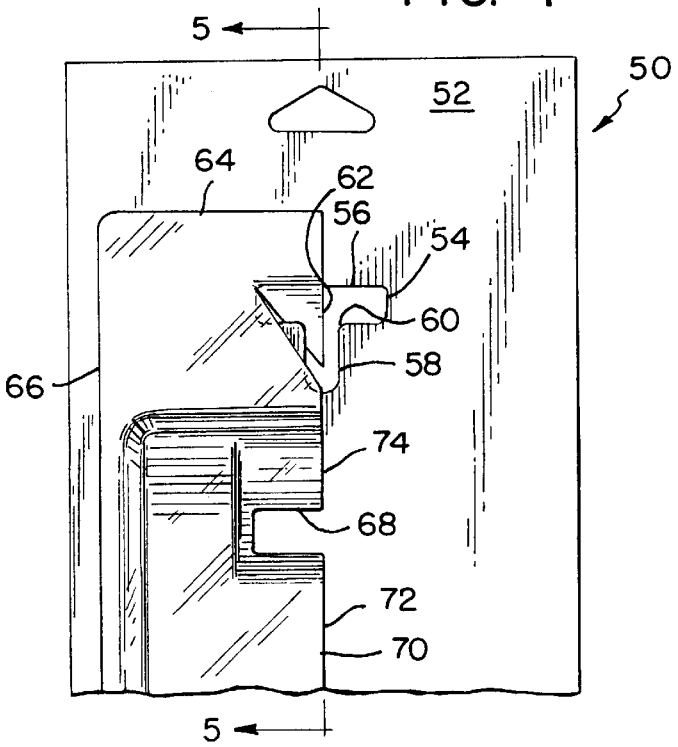
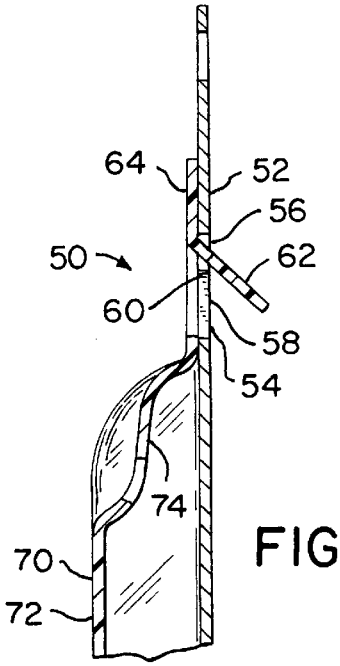
FIG. 5

INTERCONNECTING BLISTER PACKAGE

FIELD OF THE INVENTION

The present invention relates to display packages in general, and to hanging thermoformed blister packages in particular.

BACKGROUND OF THE INVENTION

Despite the resources devoted to advertising and consumer education, the ultimate retail purchase decision is made in the market aisles, when a customer encounters the desired goods. To make the act of product selection as simple and as satisfying as possible, manufacturers display their products in attractive and informative packaging. One particularly effective package for small to medium size items is the thermoformed blister package, either in a clamshell or with a paper backing card. The blister package, when made of transparent plastic, permits the customer to see the product directly, and may readily contain one item or multiple items.

While consumers seek an appealing product, appropriately displayed, they also desire to purchase a product at a competitive price. For this reason, packages have been designed to minimize the stocking and set-up time required of the merchant or the jobber who must in the end transfer the product from the manufacturer's carton to the retail shelves. Although boxed goods are usually stacked one upon another, blister packages are typically displayed upright, hanging from a projecting peg. Conventional blister packages have upper hang holes, and are placed, one after the other, on the peg.

Another approach is to mount a number of packages to a collapsed plastic strip. The upper end of the strip has a hang hole which mounts to the peg. Hence, an entire carton of packages may be hung on the peg in a single operation. Self-hanging display packages have been developed, in which the plastic blister has a frontwardly protruding plastic tab which extends from the thermoformed blister product bubble. The tab of one package extends upwardly to engage within the hang hole of an adjacent package so that a string of packages may be supported one upon another from a single peg. In addition, such packages are shipped in a carton in such a way that removal of the last package from the carton causes all the other packages to link together in a continuous chain. Nevertheless, to be formed on the protruding blister, the flexible tab must be reinforced with rib structures, and cut along a curved slot which is raised above the blister flange. In addition, the relatively large slot required can place a lower limit on the size of product which may be contained within the package. The frontward tab, moreover, can unduly obscure the product on display.

Blister packages are needed which can be readily removed in a linked array from a carton and hung together on a peg, yet which minimize product obstruction and which are economically produced.

SUMMARY OF THE INVENTION

The blister package of this invention has a thermoformed thermoplastic blister connected to a backing card having a hang hole for retail display on a protruding peg. The blister has a peripheral flange which is positioned adjacent the backing card, and a bubble which protrudes frontwardly from the flange. A catch is formed in the flange, and is deformed rearwardly through an opening in the card to extend downwardly. The plastic catch extends into a narrow slot on the bubble of another like package. The slot is approximately the same width as the catch and need be only slightly taller than the thickness of the flange. With this connection structure multiple packages may be supported one upon another. In addition, the packages will automatically link to one another when extracted from a shipping carton.

The rearwardly protruding catch may be formed from the plastic flange alone, or may be formed together with a portion of the backing card for additional strength. The plastic catch may be deformed by heat or pressure, or may be held in a rearwardly extending position by interaction with configured slots on the backing card. Alternatively, the flange may be molded to deform a portion of the backing card to act as the catch. More than one catch and slot may be formed in a package to support greater loads with improved balance.

It is an object of the present invention to provide a blister package which hangs from a like blister package with minimal obstruction to the product contained therein.

It is another object of the present invention to provide a blister package which hangs from a like blister package which is capable of securely containing small items.

It is a further object of the present invention to provide a blister package which hangs from a like blister package which may be manufactured economically.

It is also object of the present invention to provide blister packages which may be removed in a linked array from a carton yet which are not subject to cold-flow deformation while stored in the carton.

It is an additional object of the present invention to provide a blister package which may be either supported on another like package or hung individually on a peg.

It is yet another object of the present invention to provide a blister package which may be securely supported on another like blister package.

It is a still further object of the present invention to provide a blister package which may be supported from another like blister package with a high degree of load carrying capacity and balance.

Further objects, features and advantages of the invention will be apparent from the following detailed description when taken in conjunction with the accompanying drawings.

BRIEF DESCRIPTION OF THE DRAWINGS

FIG. 3 is a fragmentary isometric view of two blister packages of FIG. 1 connected together.

FIG. 4 is a fragmentary front elevational view, partially broken away, of an alternative embodiment blister package of this invention having a card hole with a shoulder retaining the catch in a rearward disposition.

FIG. 5 is a cross-sectional view of the blister package of FIG. 4 taken along section line 5—5.

DESCRIPTION OF THE PREFERRED EMBODIMENTS

Figure 1:
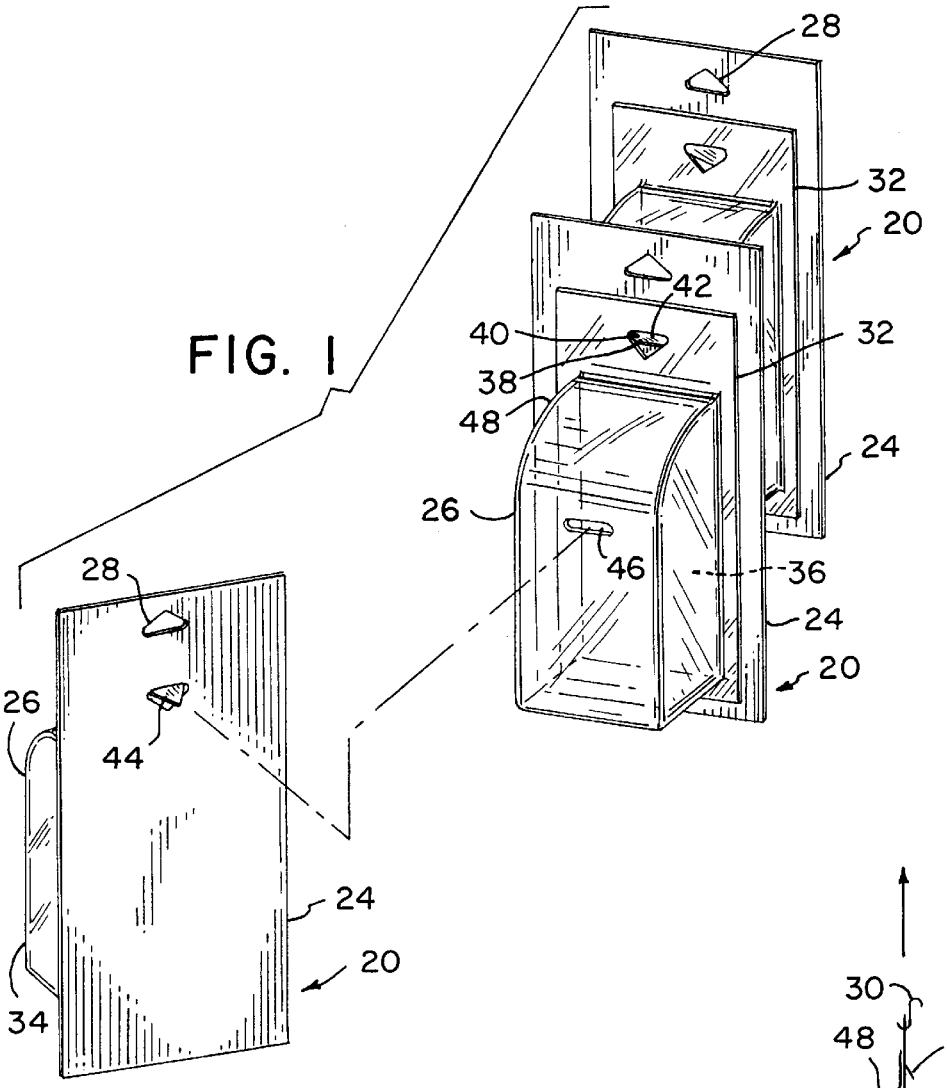
FIG. 1 is an exploded isometric view of a plurality of blister packages of this invention, one supported on another.
Figure 2:
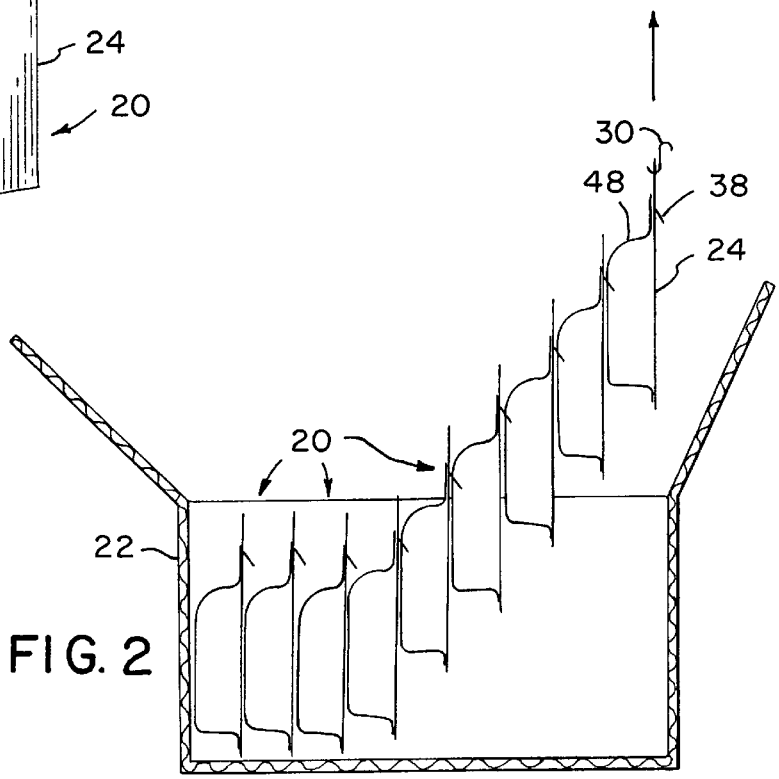
FIG. 2 is a schematic view of a number of blister packages of FIG. 1 being withdrawn from a shipping carton.

Referring more particularly to FIGS. 1–14, wherein like numbers refer to similar parts, a blister package 20 is shown in FIGS. 1–3. The blister package 20 is one of a number of like packages which, when filled with goods, will be packaged in a shipping carton 22 by the manufacturer and transported to the retailer. Each package 20 has a stiff paperboard backing card 24 to which a thermoformed thermoplastic blister 26 is affixed by any conventional technique, such as heat sealing, or adhesive attachment. The card 24 has an upper hang hole 28, usually in the form of a triangle, which hangs on a retail display peg 30. The thermoformed blister 26 has a peripheral flange 32 which extends adjacent to the card 24. A bubble 34 protrudes frontwardly from the flange 32 and defines a compartment 36 with the backing card 24 which receives and contains product.

A rearwardly and downwardly projecting catch 38 is formed from portions of the flange 32 and the card 24 above the bubble 34, as best shown in FIG. 3. The catch 38 may comprise a triangular flap 40 of plastic which extends from the flange 32 along a top bend line 42 and a triangular flap 44 of paperboard material which extends from the card. The catch 38 may be formed by simultaneously cutting and heat forming the card and the flange 32 when the two are sealed together after the bubble 34 has been loaded with product.

As shown in FIGS. 1 and 3, the blister bubble 34 has a frontwardly facing slot 46 which is at least as wide as the catch 38. The slot 46 extends horizontally, and is positioned on the bubble 34 to receive the catch 38 of an adjacent package 20. The catch 38 of a front package 20 extends into the slot 46 of an adjacent package 20. The front package thus hangs from the bubble of the package behind it. As shown in FIG. 2, an entire carton 22 of packages 20 is extracted from the carton and mounted in hanging relation in a single operation. The packages 20 are loaded vertically into the carton 22 so that the rearwardly extending catches 38 extend into the free air space above the blister bubbles 34. Thus none of the catches 38, except for the first package 20 which will hang directly on the peg 30, are deformed or depressed during shipping or storage. Because there is no pressure on the catches 38, there is no tendency of the plastic of the catch to distort or cold flow prior to being unloaded from the carton. By extending into the free air space, the resiliency and shape of the catch is preserved.

When the packages 20 are to be stocked on the retail display pegs 30, the first package is gripped adjacent the hang hole 28 is the backing card 24 and lifted straight up from the carton. The packages 20 are packed within the carton 22 with the bubble of one package adjacent to the backing card of another package. As the first package 20 raises up out of the carton, the slot 46 in the first package is brought into position below the catch of the next package. The upper wall 48 of the blister bubble 34 acts as a camming surface which depresses the resilient catch 38, so that it is pressed even with the adjacent package's backing card, until the first package is raised high enough that the catch 38 of the adjacent package can spring back into the first package's slot 46. The upper wall 48 of the blister may have a simple draft angle, or it may be formed with a convex curvature to facilitate ready engagement between the catches and the slots.

As the first package 20 is drawn out of the carton 22, successive packages are linked together, until all the packages are connected in a hanging array which is then secured to the retail display peg 30.

The package 20 may be manufactured in the thermoforming process, in which a single sheet of heated thermoplastic material is positioned over a mold on which vacuum is drawn. The heated sheet is then drawn onto the mold and cooled, thereby assuming the shape of the mold. The molded article is then trimmed, at which point the slot, the hang hole, and portions of the catch may also be formed. The depressed catch plastic and card may be formed in a separate step at the time of loading the blister.

The connecting structure of the package 20 offers a number of packaging benefits. Because the catch 38 is formed from the flange and the card of the package, it does not interfere with the viewing of the package's contents. Furthermore, when the blister is formed on a recessed cavity female thermoforming mold, the flange will tend to be the thickest part of the sheet after molding. Because the catch is formed in the flange it will have additional strength because of the thicker plastic material. Moreover, because only a narrow slot is needed on the bubble to receive the catch, multiple small products may be stored in the bubble, with the only requirement being that the products not be so small as to risk escape through the slot 46.

An alternative embodiment package 50 of this invention is shown in FIGS. 4 and 5. The package 50 eliminates any requirement to form the blister at the time of filling of the package. As shown in FIG. 4, the package 50 has a backing card 52 having a T-shaped catch hole 54. The catch hole 54 has a horizontal slot 56 from which extends a vertical slot 58. Two shoulders 60 are defined by the card 52 on either side of the vertical slot 58 below the horizontal slot 56. The shoulders 60 are somewhat flexible, such that the plastic catch 62 formed from the flange 64 of the plastic blister 66 may be pressed past the two shoulders 60, and then held in a rearwardly projecting position by the shoulders, as shown in FIG. 5. Alternatively, the blister may be slid into position with backing card catch hole 54 by use of a positioning jig, as shown in FIG. 8, and discussed in more detail below.

The package 50 has a slot 68 on the front wall 70 of the blister bubble 72 which receives the catch 62 of an adjacent package in a manner similar to the package 20. The slot 68 may be formed within a rearwardly extending shell 74 formed in the bubble 72, to impart greater stiffness to the material surrounding the slot 68, and to thus support greater loads without undesirable distortion.

Figure 6:
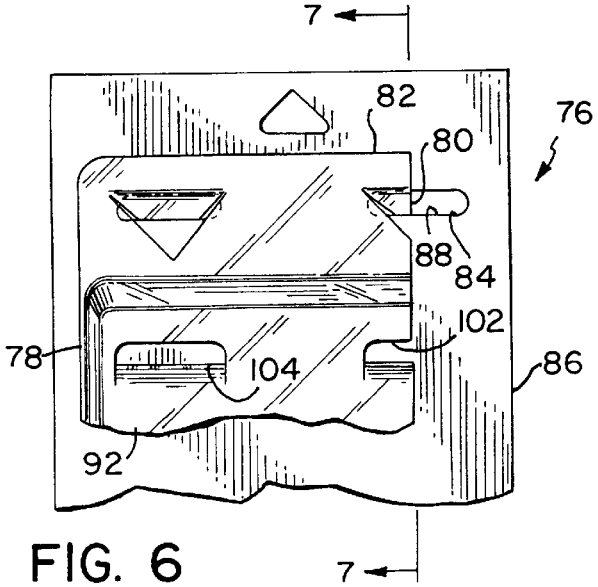
FIG. 6 is a fragmentary front elevational view, partially broken away, of another alternative embodiment blister package of this invention having an oblong card hole.
Figure 7:
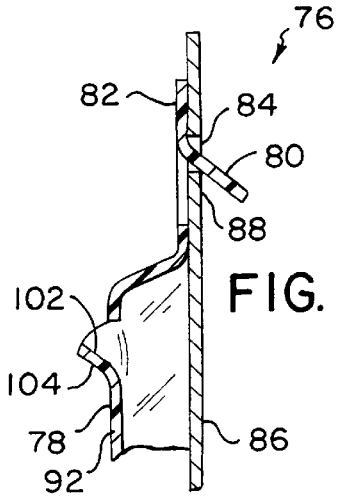
FIG. 7 is a cross-sectional view of the blister package of FIG. 6 taken along section line 6—6.
Figure 8:
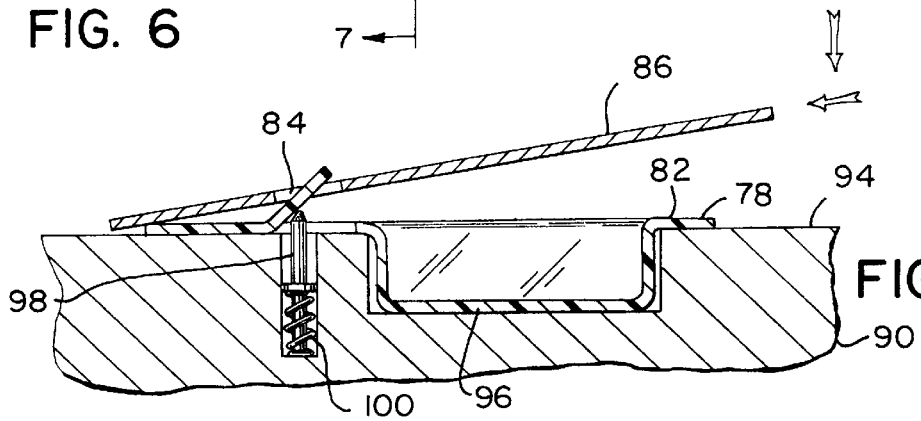
FIG. 8 is a schematic cross-sectional view of a jig for assembly of the package of FIG. 6.

Yet another alternative embodiment package 76 of this invention is shown in FIGS. 6–8. The package 76 has a thermoformed plastic blister 78 having a triangular catch 80 which is formed in the blister flange 82 and which extends rearwardly through an oblong horizontal catch slot 84 in a backing card 86. The lower edge of the catch slot 84 acts as a shoulder 88 which retains the plastic catch 80 in a rearward orientation. Because the catch 80 is larger than the oblong slot 84, it cannot be pressed directly through the slot. Hence, a jig 96, such as the one shown in FIG. 8, may be employed to associate the backing card 86 with the blister 78 after loading of the blister bubble 92. The jig 90 has a platform 94 which supports the front surface of the blister flange 82. A cavity 96 in the platform 94 receives the blister product bubble 92. A thermoformed and trimmed blister 78 is dropped into position on the platform 94 and loaded with product. A pin 98 is biased upwardly by a spring 100 to extend above the platform 94 and engage against the plastic catch 80. With the catch 80 thus elevated, the card 86 is dropped downwardly toward the platform 94 and urged sidewardly toward the pin 98 to allow the catch slot 84 in the backing card 86 to pass over the plastic catch 80. The card 86 is then sealed to the blister 78.

The package 76 may have a front slot similar to those of the packages 20, 50, or it may have a slot 102 having a frontwardly protruding lip 104 to assist engagement of the catch of one package with the slot of another. As shown in FIG. 6, the packages of this invention may conveniently have more than one set of slots and catches on a single package. Multiple catches and slots permit the load of the supported packages to be distributed over a greater expanse of plastic, and thus may permit heavier package weights, or support of the same loads with less deformation of the package or with thinner gauge plastic.

Figure 9:
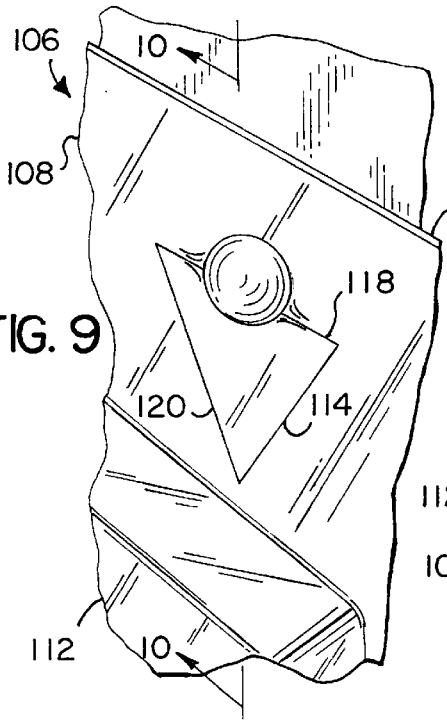
FIG. 9 is a fragmentary isometric view of another alternative embodiment blister package of this invention having a formed bottom catch.
Figure 10:
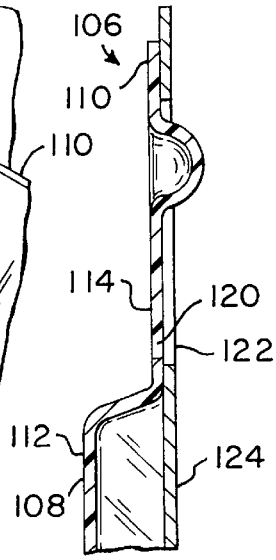
FIG. 10 is a cross-sectional view of the blister package of FIG. 9 taken along section line 10—10 showing the catch in an as-formed position.
Figure 11:
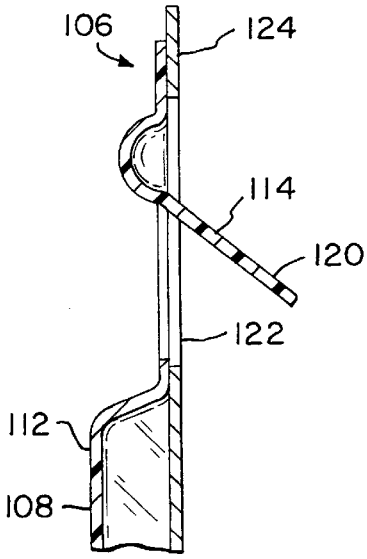
FIG. 11 is a cross-sectional view of the blister package of FIG. 10, showing the catch pushed over-center to protrude rearwardly through a hole in an attached backing card.

Yet another alternative embodiment package 106 of this invention is shown in FIGS. 9–11. The package 106 has a thermoformed blister 108 having a peripheral flange 110 which extends sidewardly from a protruding product bubble 112. A catch 114 is thermoformed and die cut in the flange 110, as shown in FIG. 10. The catch 114 is formed with a rearwardly protruding generally semispherical button 116 which extends along the hinge line 118 of a triangular catch flap 120 which is die cut along two sides. A catch clearance hole 122 is die cut in the backing card 124 to allow the catch flap 120 to be pivoted through the catch clearance hole by depressing the button 116 and inverting it to protrude frontwardly, as shown in FIG. 11. When depressed from the as-formed position shown in FIG. 10, the button 116 will resiliently retain the catch flap 120 in a rearwardly extending position.

Figure 12:
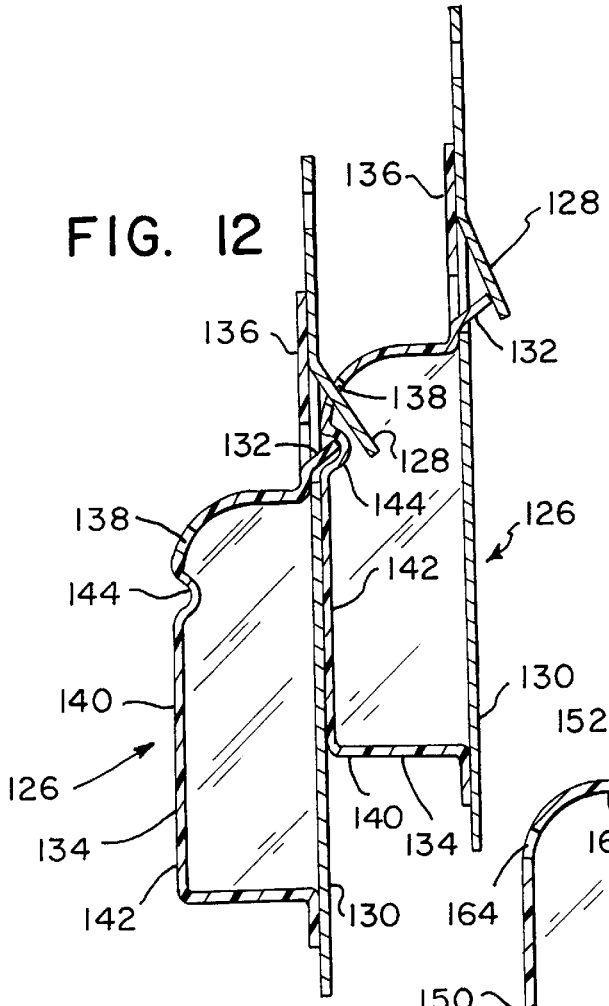
FIG. 12 is a cross-sectional view of two connected alternative embodiment blister packages of this invention having a catch formed by a rearwardly disposed portion of the backing card.

Another alternative embodiment package 126 of this invention is shown in FIG. 12. The package 126 has a catch formed by a triangular flap 128 die cut from a paperboard backing card 130. Rearward biasing to the paperboard flap 128 is provided by a rearwardly and upwardly protruding plastic tab 132 formed from a portion of the thermoformed plastic blister 134 flange 136. When two packages 126 are brought into engagement, the paperboard flap 128 is received within a slot 138 formed in the frontwardly protruding bubble 140 of the blister 134. In the engaged position, the flap 128 is no positioned against the plastic tab 132. To prevent the plastic tab 132 from engaging against the front wall 142 of the blister bubble 140 and tipping the package, a recess 144 is formed in the blister bubble below the slot 138 to receive the plastic tab 132 when the packages 126 are connected together in a hanging array.

Figure 13:
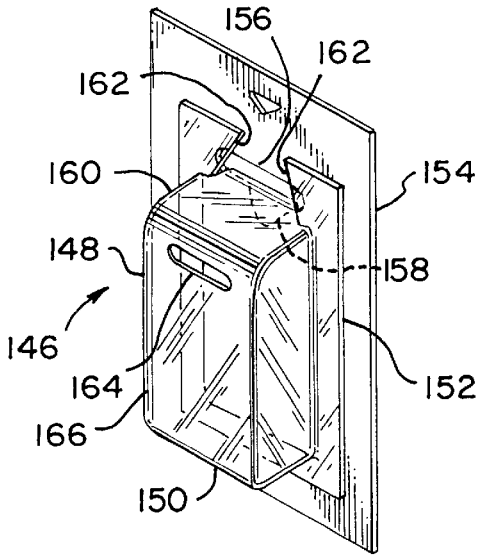
FIG. 13 is an isometric view of another alternative embodiment package of this invention having a catch formed by portions of the blister flange.
Figure 14:
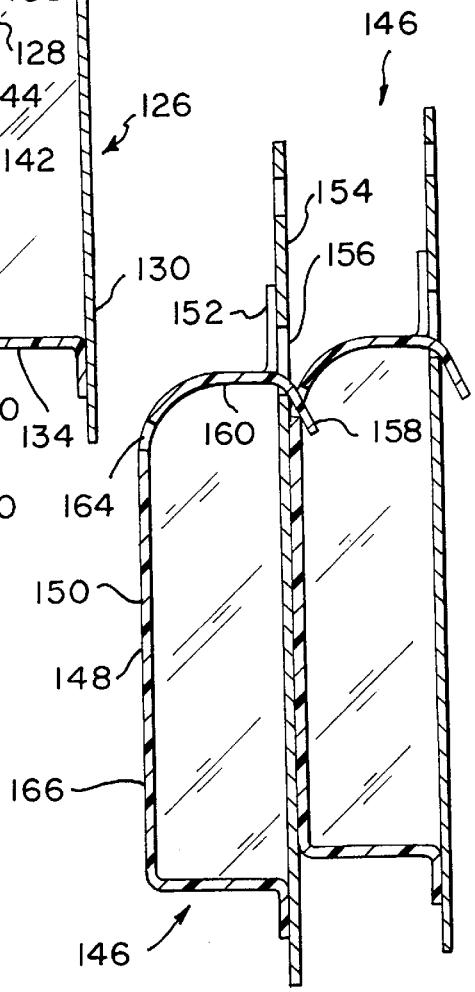
FIG. 14 is a cross-sectional view of two joined blister packages of FIG. 13.

Another alternative embodiment package 146 of this invention is shown in FIGS. 13 and 14. The package 146 has a thermoformed thermoplastic blister 148 with a protruding product bubble 150 and a sidewardly extending flange 152. The flange 152 is connected to a planar backing card 154 having a catch opening 156. A catch 158 extends rearwardly from the top wall 160 of the bubble 150. The catch 158 is a flap generally in the shape of a truncated triangle. The blister 148 is preferably thermoformed so that the catch 158 flap lies in the same plane as the flange 152, but is cut from the flange along two edges 162. Alternatively, the catch 158 may be formed so that it extends rearwardly, but not downwardly. In either case, the formed blisters 148 may be conveniently stacked and nested. When the packager has filled the bubble 150 with product, and preferably in connection with a heat-sealing step in which the blister flange 152 is sealed to the backing card 154, the catch 158 is bent to extend not only rearwardly, but downwardly as well. In the bent position, the catch 158 will engage with a slot 164 cut in the front wall 166 of the blister bubble 150. If the catch 158 is folded back and down in the sealing process, the catch opening 156 in the backing card will need to be large enough to permit this catch displacement. On the other hand, if the catch has been formed in the thermoforming step to extend generally rearwardly, the card need only have a slot slightly bigger than the thickness and width of the catch 150 in order to receive the catch prior to bending.

It is understood that the invention is not limited to the particular construction and arrangement of parts herein illustrated and described, but embraces such modified forms thereof as come within the scope of the following claims.

I claim:

1. A blister package comprising:

a backing card;

a thermoformed plastic blister connected to the backing card, the blister having a peripheral flange which is positioned adjacent the backing card, and a bubble which protrudes frontwardly from the flange;

portions of the blister flange which define a catch which projects rearwardly from the bubble to extend through the card and project rearwardly from the card;

portions of the blister bubble defining a frontwardly facing slot, wherein the slot receives the rearwardly projecting catch of a like blister package to support said like blister package on the blister bubble.

2. The blister package of claim 1 wherein the flange catch is positioned above the bubble slot, such that when blister packages are positioned within a shipping carton with the bubble of a first blister package adjacent to the card of a second blister package, the catch in the second blister package is not in engagement with the first package.

3. The blister package of claim 1 wherein portions of the backing card adjacent the flange catch extend rearwardly to define a compound catch composed of the flange catch and portions of the backing card which are received within the bubble slot of an adjacent package.

4. The blister package of claim 1 wherein portions of the backing card define a horizontal slot, and wherein the flange catch extends rearwardly through the slot, the slot being smaller than the flange to thereby retain the flange catch in a rearward orientation.

5. The blister package of claim 4 wherein portions of the card define a vertical slot extending downwardly from the horizontal slot, and wherein portions of the card define a shoulder on either side of the vertical slot and beneath the horizontal slot, the shoulders engaging with the flange catch and biasing it rearwardly.

6. The blister package of claim 1 further comprising a rearwardly protruding button formed in the blister flange adjacent the catch, the catch extending from the button such that when the button is depressed to protrude frontwardly, the catch is biased rearwardly.

7. The blister package of claim 1 wherein the catch is hinged along a lower hinge line adjacent the bubble blister.

8. A blister package comprising:

a backing card;

a thermoformed thermoplastic blister connected to the backing card, the blister having a frontwardly protruding bubble, and a flange which extends sidewardly from the bubble adjacent the backing card;

portions of the backing card and blister flange which define a catch which extends rearwardly from the card; and portions of the blister bubble which define a frontwardly facing slot, the slot being positioned to receive the rearwardly extending catch of a like package positioned adjacent the blister bubble.

9. The blister package of claim 8 wherein the catch comprises:

a plastic flap extending from the blister flange; and a tab extending from the card adjacent to the plastic flap, the plastic flap and the tab together extending rearwardly for engagement with the slot of an adjacent package.

10. The blister package of claim 8 wherein the catch comprises:

a plastic flap extending rearwardly from the blister flange;

portions of the backing card which define a horizontal slot through which the plastic flap extends, the plastic flap being biased rearwardly by engagement with the card as it extends through the slot.

11. The blister package of claim 10 further comprising portions of the card which define a vertical slot extending from the horizontal slot, wherein portions of the card define a shoulder on either side of the vertical slot, the shoulders engaging the plastic flap to direct it rearwardly.

12. The blister package of claim 8 wherein the plastic flap extends from a button formed in the blister flange, the button being convex and protruding rearwardly in the as-formed position, wherein the button may be depressed to be concave and frontwardly protruding in a completed position, the plastic flap extending rearwardly from the button in the completed position.

13. The blister package of claim 8 wherein the catch comprises:

portions of the flange which extend from a hinge line adjacent the bubble; and portions of the backing card which define a slot through which the flange portions extend.

14. The blister package of claim 8 wherein the catch comprises:

portions of the backing card which define a rearwardly and downwardly extending flap;

portions of the blister flange which define a rearwardly protruding tab which extends upwardly to engage the backing card flap and bias the flap rearwardly.

15. The blister package of claim 14 further comprising portions of the blister bubble which define a recess positioned below the bubble slot, the recess receiving the plastic tab when two like packages are connected together.

16. A blister package comprising:

a backing card having portions defining a catch opening;

a thermoformed thermoplastic blister connected to the backing card, the blister having a frontwardly protruding bubble, and a flange which extends sidewardly from the bubble adjacent the backing card;

portions of the blister flange which extend rearwardly from the blister along a fold line to define a flap which extends rearwardly through the card catch opening; and portions of the blister bubble which define a frontwardly facing slot, the slot being positioned to receive the rearwardly extending flap of a like package positioned adjacent the blister bubble.

17. The blister package of claim 16 wherein the catch opening has a horizontal slot and a vertical slot extending from the horizontal slot, and wherein shoulders are defined on each side of the vertical slot, the shoulders serving to support the flap in a rearward orientation.

18. The blister package of claim 16 further comprising a rearwardly protruding button formed in the blister flange adjacent the flap along the hinge line, the catch extending from the button such that when the button is depressed to protrude frontwardly, the flap is biased rearwardly.

19. The blister package of claim 16 wherein the bend line is positioned beneath portions of the flange flap.

20. The blister package of claim 16 wherein the bend line is positioned above the flange flap.

* * * * *